US005529511A

United States Patent [19]

Matsuoka

[11] Patent Number: 5,529,511

[45] Date of Patent: Jun. 25, 1996

[54] ELECTRICAL CONTACT

[75] Inventor: Noriyuki Matsuoka, Yokohama, Japan

[73] Assignee: Yamaichi Electronics Co., Ltd., Tokyo, Japan

[21] Appl. No.: 497,254

[22] Filed: Jun. 30, 1995

[30] Foreign Application Priority Data

Jun. 30, 1994 [JP] Japan ..... 6-171634

[51] Int. Cl.[6] ..... H01R 4/50

[52] U.S. Cl. ..... 439/342; 439/259

[58] Field of Search ..... 439/259, 342, 439/856, 857, 75

[56] References Cited

U.S. PATENT DOCUMENTS 4,412,713 11/1983 Nishikawa ..... 439/75
4,531,792 7/1985 Oshitani et al. ..... 439/342
5,044,973 9/1991 Noda et al. ..... 439/342
5,299,950 4/1994 Kaneko ..... 439/342

*Primary Examiner*—Neil Abrams
*Assistant Examiner*—Yong Kim
*Attorney, Agent, or Firm*—Wenderoth, Lind & Ponack

[57] ABSTRACT

In an electrical contact, upper end portions of a pair of contact piece portions formed by blanking are bent along respective inclined folding lines into a generally inverted L-shape to form a pair of lead holding portions, so that a lead receiving slot is formed between the pair of lead holding portions, the two inclined folding lines being disposed respectively on blanked-out surfaces of the two contact piece portions. With this construction, the blanking is effected in such a manner that the pair of lead holding portions, as well as the pair of contact piece portions, can be spaced a sufficient distance from each other, and then by bending these lead holding portions, there can be formed the lead receiving slot having a sufficiently narrow width. Thus, the requirement for the narrow design of the lead receiving slot can be met, and therefore this electrical contact can be suitably used for a lead wire of a very thin design.

2 Claims, 11 Drawing Sheets

ELECTRICAL CONTACT

BACKGROUND OF THE INVENTION

1. Field of the Invention

This invention relates to an electrical contact or contact member having a pair of contact piece portions for resiliently holding a lead wire of an electric part to electrically contacting the electrical contact with the lead wire.

2. Related Art

There is known a socket of the type in which a movable plate is mounted on an upper surface of a socket body for lateral movement so as to bring lead wires of an IC package into and out of engagement with respective electrical contacts mounted on the socket body. Each electrical contact has a pair of contact piece portions for holding the lead wire therebetween.

One such socket is of the type in which the movable plate is moved laterally to urge the pair of contact piece portions of each electrical contact away from each other, and then the IC package is placed on the movable plate, so that each lead wire of the IC package is inserted through the movable plate into a gap between the pair of contact piece portions of the corresponding electrical contact, mounted in the socket body, without applying a load. Another such socket is of the type in which the IC package is placed on the movable plate, and each lead wire of the IC package is brought into a position adjacent to the corresponding electrical contact, and then the movable plate is laterally moved together with the IC package, so that the wire lead of the IC package is introduced between the pair of contact piece portions of the corresponding electrical contact.

In the latter socket, a wiping effect can be expected when laterally moving the IC package so as to introduce the lead wire between the pair of contact piece portions, thus achieving an advantage that the reliability is enhanced. This contact type has been extensively used for PGA-type ICs.

One electrical contact of such a contact type is disclosed, for example, in U.S. Pat. No. 4,412,713. As shown in FIGS. 19 to 22, this electrical contact includes a pair of left and right contact piece portions 1 and 2 formed by blanking, and a pair of lead holding portions 3 and 4 formed respectively by perpendicularly bending upper end portions of the contact piece portions 1 and 2.

The two lead holding portions 3 and 4 are bent along respective folding lines 5 passing horizontally across blanked-out surfaces 1*a* and 2*a* of the contact piece portions 1 and 2, so that each contact piece portion 1, 2 assumes a generally inverted L-shape. As a result, a lead receiving slot 6 is formed between the two holding portions 3 and 4.

The IC lead wire is moved laterally into the lead receiving slot 6 through an outer open end thereof. At this time, the IC lead wire is rubbed by blanking shear surfaces 1*b* and 2*b* of the lead holding portions 3 and 4 defining the slot 6, thus achieving a wiping effect.

The electrical contact of the above construction has the above-mentioned advantage; however, the lead receiving slot 6 between the two lead holding portions 3 and 4 is required to have a predetermined width W when the electrical contact is formed by blanking as shown in FIG. 19, and the reduction of the width W of the lead receiving slot 6 is limited because this slot 6 is formed through blanking. Thus, the above electrical contact has a problem that it can not be suited for use with the very thin, high-density design of the IC lead wires that has been developed recently.

SUMMARY OF THE INVENTION

It is therefore an object of this invention to provide an electrical contact which overcomes the above problems, and enhances the advantages of the conventional construction.

According to the present invention, there is provided an electrical contact which includes a lead holding portion formed by bending an upper end portion of a contact piece portion along an inclined folding line which is slanting downwardly from an inner side edge of the contact piece portion to an outer side edge thereof, and the lead holding portion and a blanking shear surface thereof, serving to form a lead receiving slot, are slanting in respective directions to narrow a width of a lower side of the lead receiving slot.

In the above electrical contact, the above construction is applied to one or both of the pair of lead holding portions.

In the above electrical contact, when the lead holding portion is in its developed form, the gap between the pair of the lead holding portions is much larger than the width of the lead receiving slot to be formed upon bending.

In other words, the blanking is effected in such a manner that the gap between the two contact piece portions having the respective lead holding portions is larger than the width of the lead receiving slot, and then by bending the two contact piece portions, the lead receiving slot having the narrow width can be formed.

This advantageous effect can be obtained with the construction in which one or both of the pair of lead holding portions are bent along the inclined folding line which is disposed on a blanked-out surface of the contact piece portion, and is slanting downwardly outwardly.

When the contact piece portion is bent along the inclined folding line, the lead holding portion and the blanking shear surface, serving to form the lead receiving slot, are slanting in the respective directions to narrow the width of the lower side of the lead receiving slot As a result, a lower edge of the blanking shear surface can contact a peripheral surface of a lead wire of an electric part under pressure so as to perform a wiping effect, thereby enhancing the reliability in contact between the electrical contact and the lead wire.

DESCRIPTION OF THE PREFERRED EMBODIMENTS OF THE INVENTION

Figure 17:
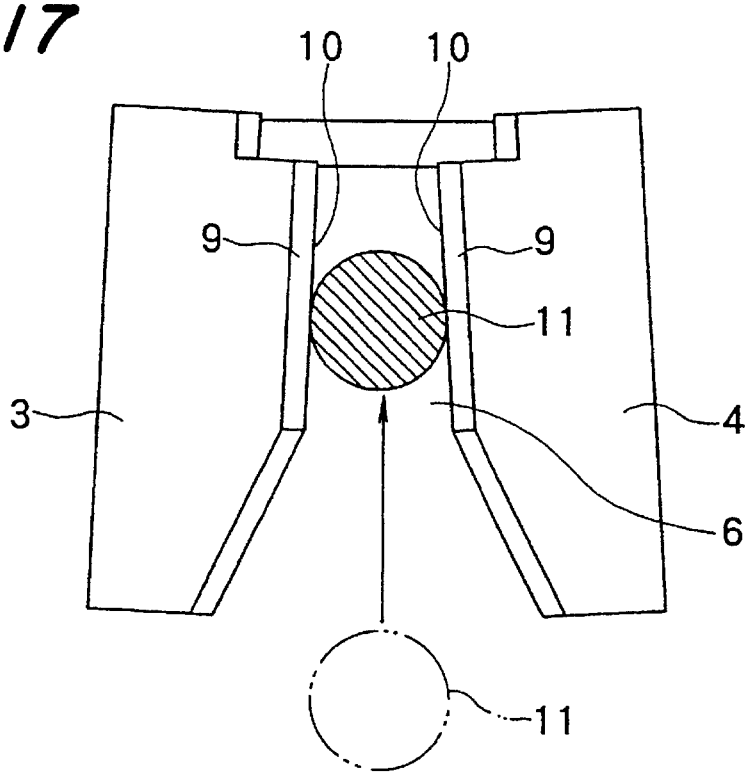
FIG. 17 is a cross-sectional view showing a condition of contact between a lead wire and the electrical contact of each embodiment from the top of the electrical contact.
Figure 18:
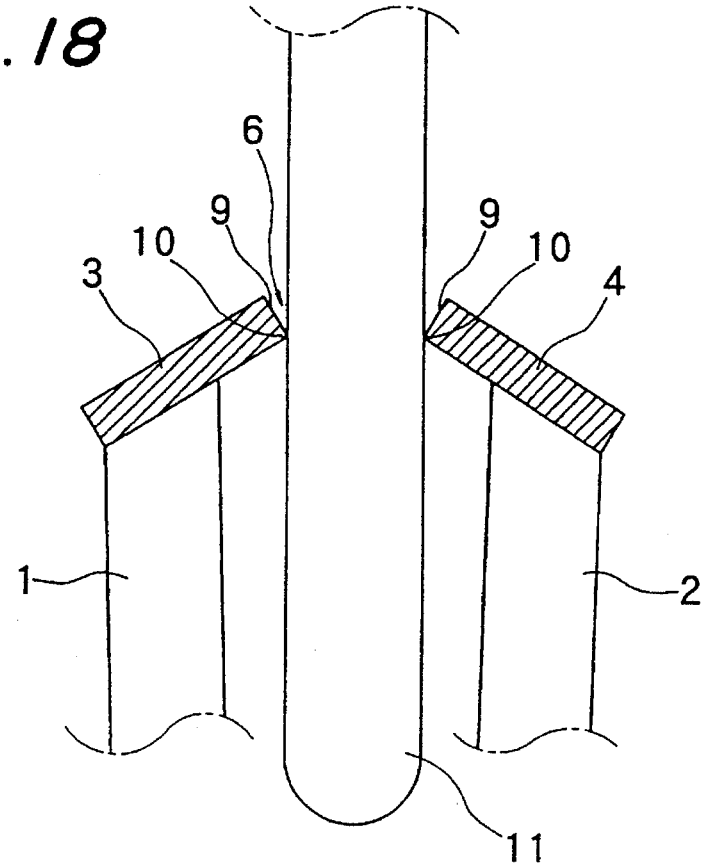
FIG. 18 is a cross-sectional view showing the above contact condition from the side of the electrical contact.
Figure 19:
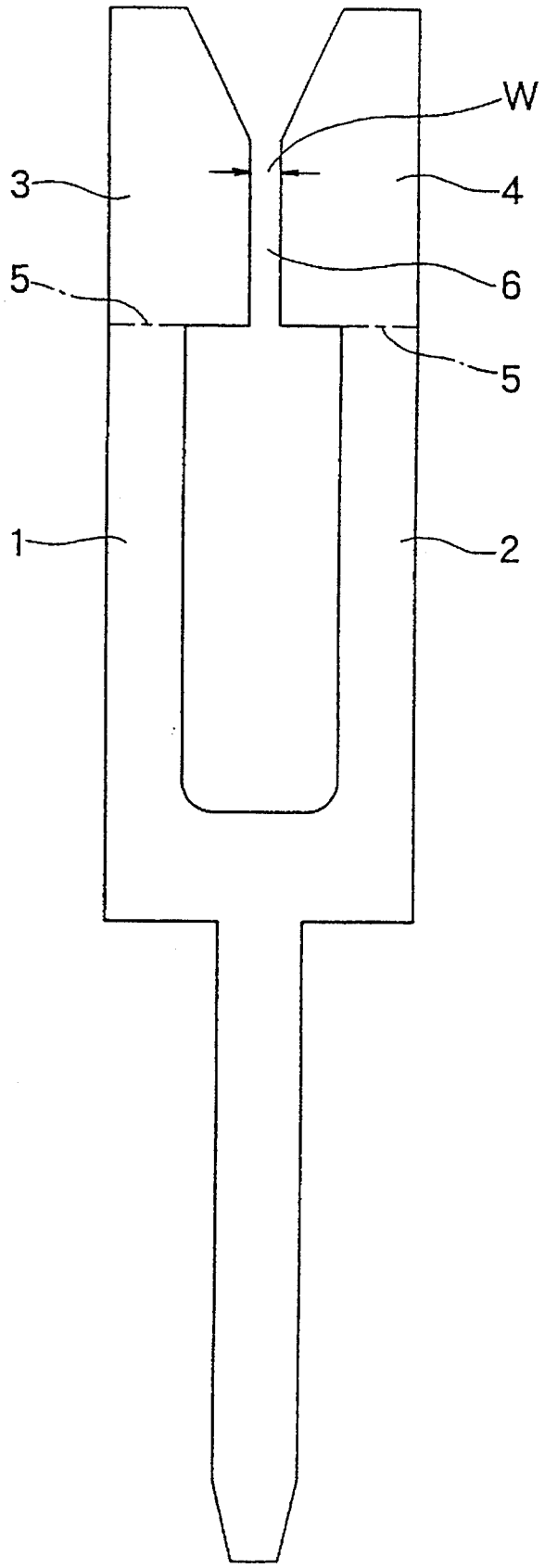
FIG. 19 PRIOR ART
FIG. 19 is a front-elevational view of an electrical contact of the prior art in its blocked configuration.
Figure 20:
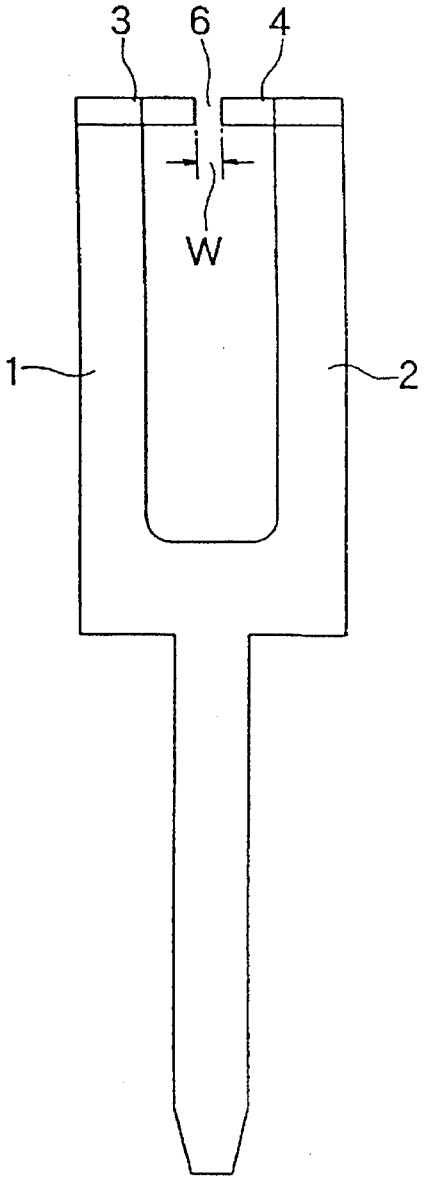
FIG. 20 PRIOR ART
FIG. 20 is a front-elevational view of the prior art electrical contact.
Figure 21:
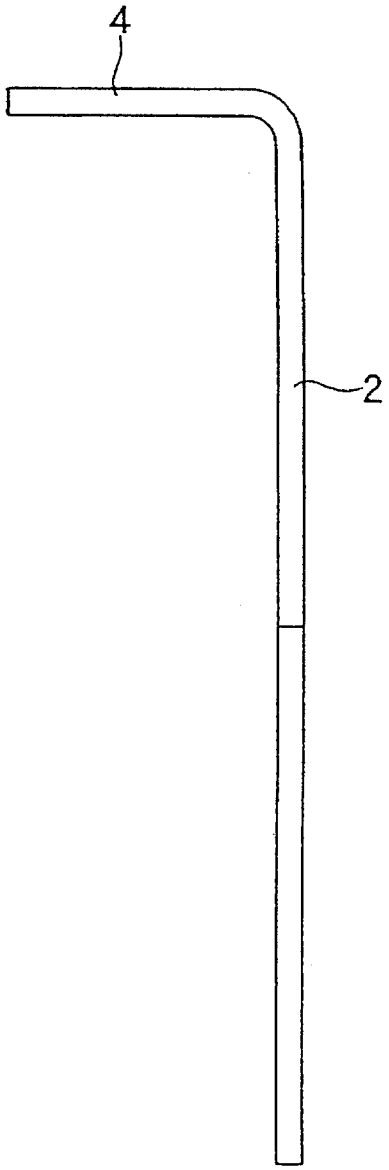
FIG. 21 PRIOR ART
FIG. 21 is a side-elevational view of the prior art electrical contact.
Figure 22:
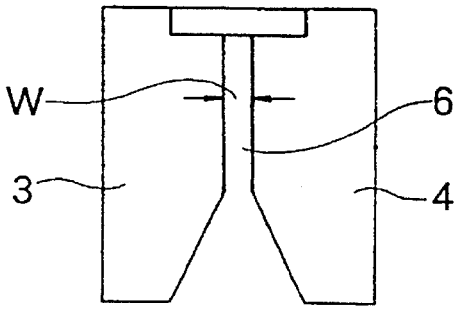
FIG. 22 PRIOR ART
FIG. 22 is a plan view of the prior art electrical contact.

FIGS. 1 to 6 show a first preferred embodiment of the present invention, FIGS. 7 to 11 shows a second preferred embodiment of the invention, and FIGS. 12 to 16 shows a third preferred embodiment of the invention. FIGS. 17 and 18 are views showing a condition in which an electrical contact of each embodiment is contacted with a lead wire of an electric part or component.

Figure 1:
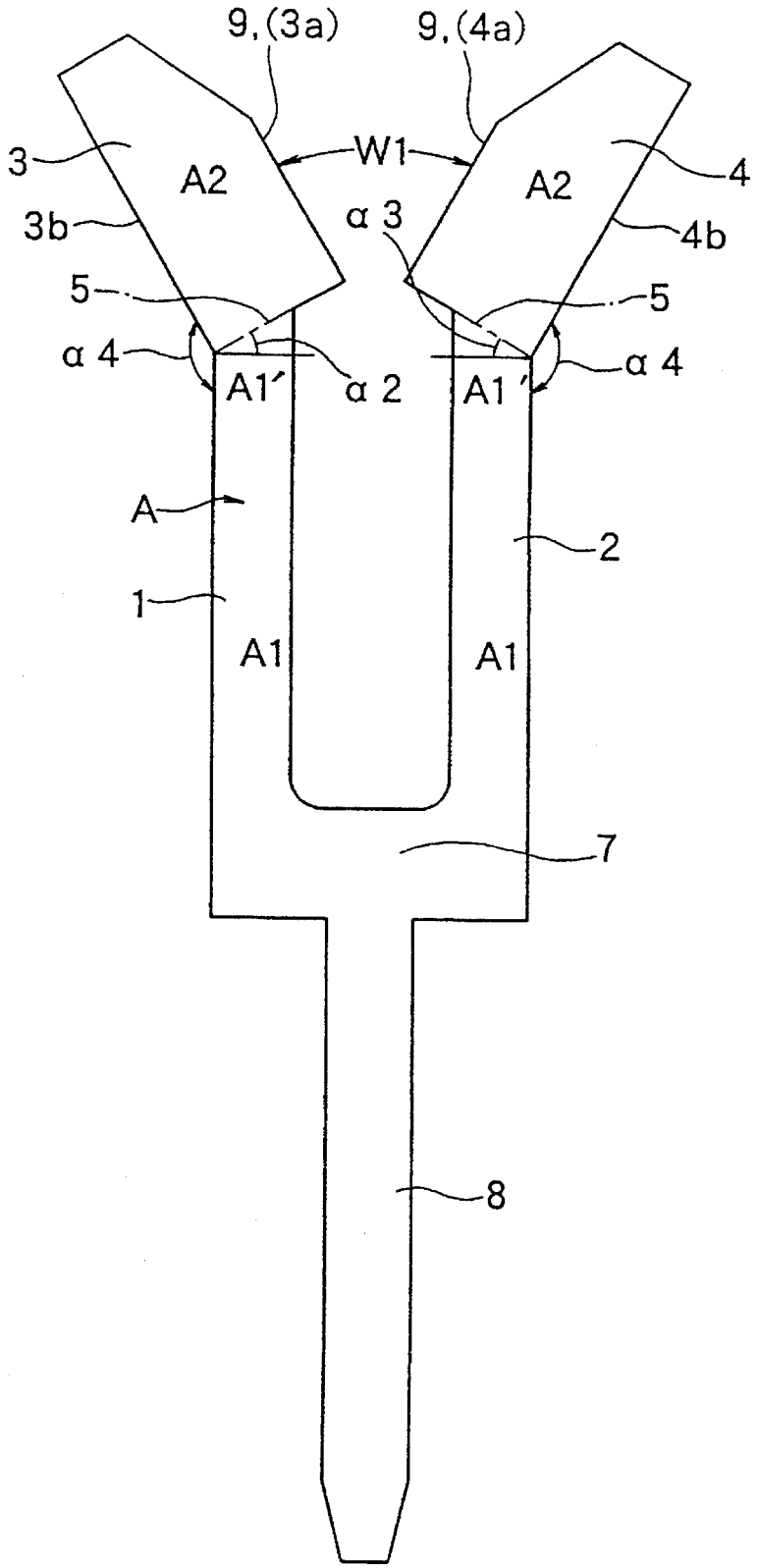
FIG. 1 is a front-elevational view of a first embodiment of an electrical contact of the present invention in its blanked configuration.
Figure 7:
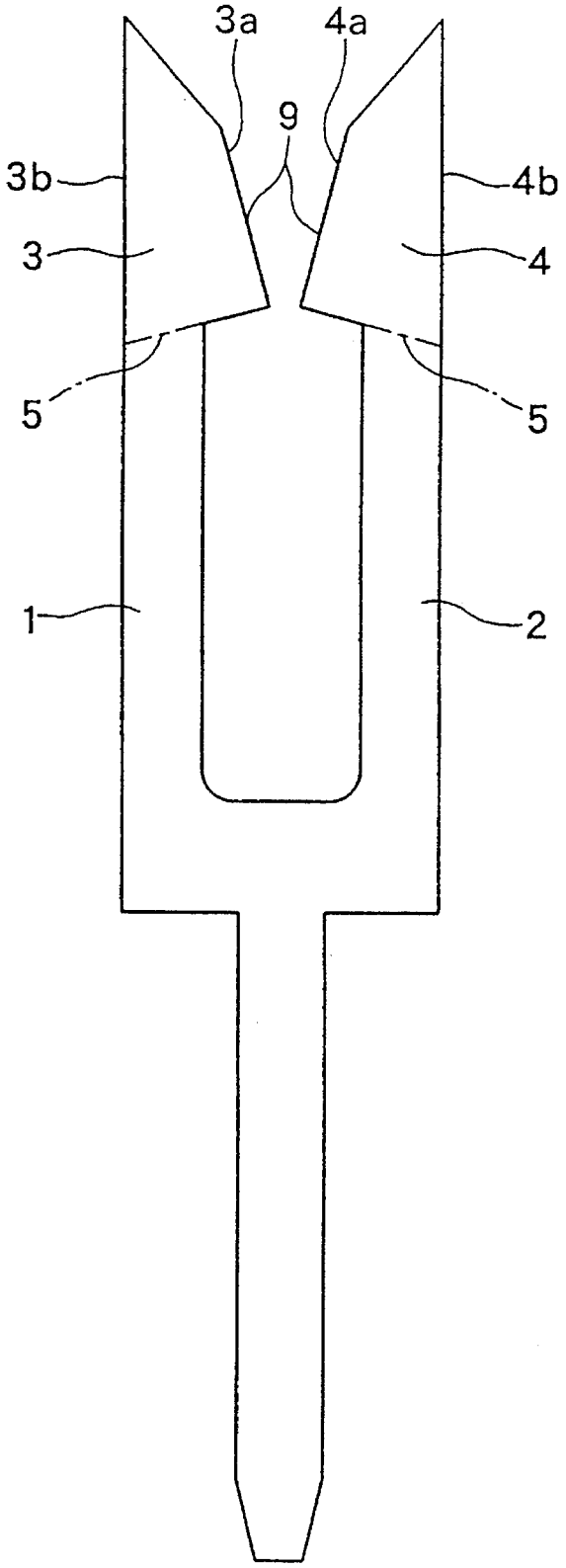
FIG. 7 is a front-elevational view of a second embodiment of an electrical contact of the invention in its blanked configuration.

First, the first and second embodiments will now be described together. FIGS. 1 and 7 (developed views) among FIGS. 1 to 11 show electrical contacts of the first and second embodiments in their blanked condition, respectively, and the other Figures show the electrical contact in which lead holding portions are formed by bending.

The electrical contact includes a pair of left and right contact piece portions 1 and 2 formed by blanking. The two contact piece portions 1 and 2 are juxtaposed parallel to each other, and are spaced a predetermined distance from each other. A blanked-out surface A of each of the contact piece portions 1 and 2 is directed in a forward-rearward direction. Here, the term "blanked-out surface" means that side or surface from which a cutting edge of a blanking die comes out.

The pair of contact piece portions 1 and 2 are interconnected at their lower ends by a connecting portion 7, so that the two contact piece portions 1 and 2 extend upwardly from the connecting portion 7. A male terminal 8 extends downwardly from the connecting portion 7, for example, for insertion into a through hole in a circuit board.

The contact piece portions 1 and 2 are bent at their upper end portions forwardly or rearwardly respectively along inclined folding lines 5, lying on the respective blanked-out surfaces A, into a generally inverted L-shape to provide a pair of lead holding portions 3 and 4, respectively. A lead receiving slot 6 is formed between the pair of lead holding portions 3 and 4. $\alpha 1$ denotes an angle of bending of the lead holding portion 3, 4 with respect to the blanked-out surface A.

Each inclined folding line 5 is slanting downwardly from an inner side edge of the contact piece portion 1, 2 to an outer side edge thereof. In other words, the two inclined folding lines 5, disposed respectively on the blanked-out surfaces A of the contact piece portions 1 and 2, are slanting downwardly left and right respectively toward the outer sides of the blanked-out surfaces A at respective inclination angles $\alpha 2$ and $\alpha 3$.

With this arrangement, a relatively wide blanking gap W1 required for forming the lead receiving slot 6 is formed between the lead holding portions 3 and 4, and then by bending these holding portions 3 and 4, the lead receiving slot 6 having a sufficiently narrow width W2 can be formed.

Therefore, a blanking gap between the two contact piece portions 1 and 2 can be sufficiently larger than the width W2 of the lead receiving slot 6. In the present invention, only one of the lead holding portions may be bent along the inclined folding line 5.

Where the pair of the lead holding portions 3 and 4 are bent along the respective inclined folding lines 5, the inclination angles $\alpha 2$ and $\alpha 3$ are, for example, equal to each other. In this case, the pair of lead holding portions 3 and 4 are bent forwardly or rearwardly along the respective inclined folding lines 5 (which are disposed at the same angle ($\alpha 2=\alpha 3$)) on the respective blanked-out surfaces A.

In other examples of the invention, the inclination angles $\alpha 2$ and $\alpha 3$ can be different from each other.

The angle $\alpha 1$ of bending of the lead holding portion 3, 4 with respect to the blanked-out surface A is substantially 90 degrees. This angle $\alpha 1$ can be varied in the range of 90°±30° in accordance with a desired design. Namely, the lead holding portion 3, 4 can be slanting upwardly or downwardly.

The width W2 of the lead receiving slot 6 formed between the lead holding portions 3 and 4 is determined by the above angles $\alpha 1$, $\alpha 2$ and $\alpha 3$. Namely, the larger the angles $\alpha 2$ and $\alpha 3$, the smaller the width W2 of the slot 6. In contrast, the smaller the angle $\alpha 1$ of bending of the lead holding portion 3, 4 with respect to the blanked-out surface A, the smaller the width W2 of the slot 6.

Figure 3:
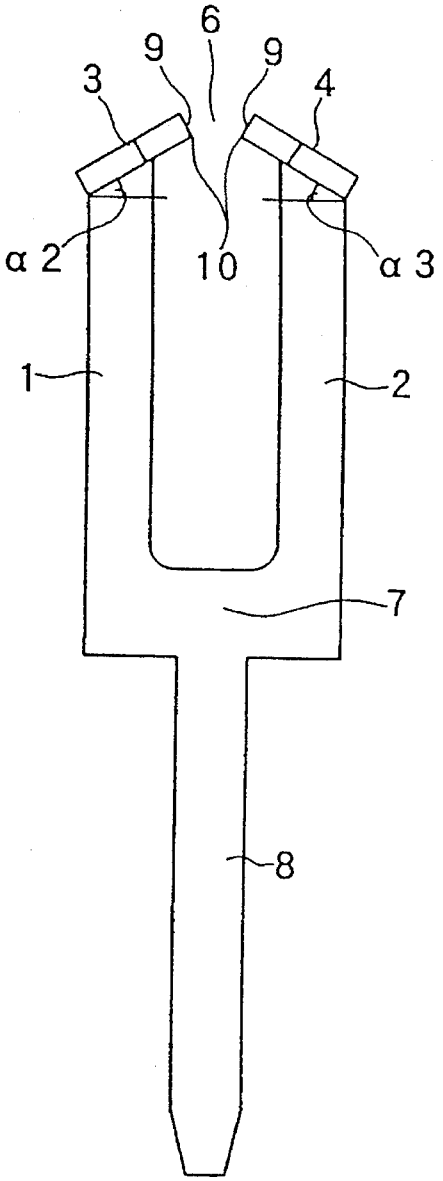
FIG. 3 is a front-elevational view of the electrical contact.
Figure 4:
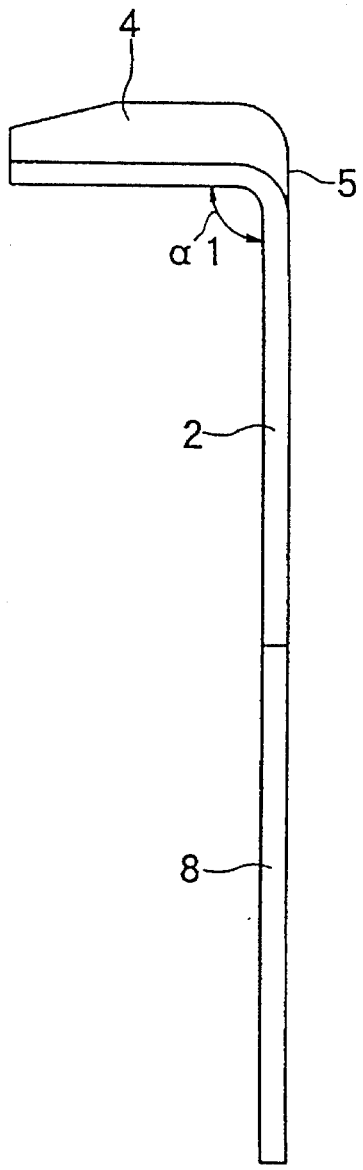
FIG. 4 is a side-elevational view of the electrical contact.
Figure 5:
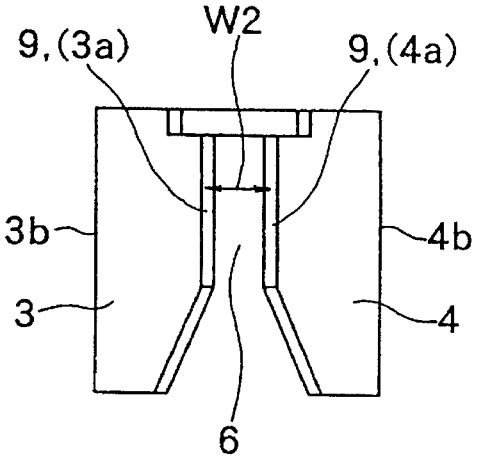
FIG. 5 is a plan view of the electrical contact.
Figure 6:
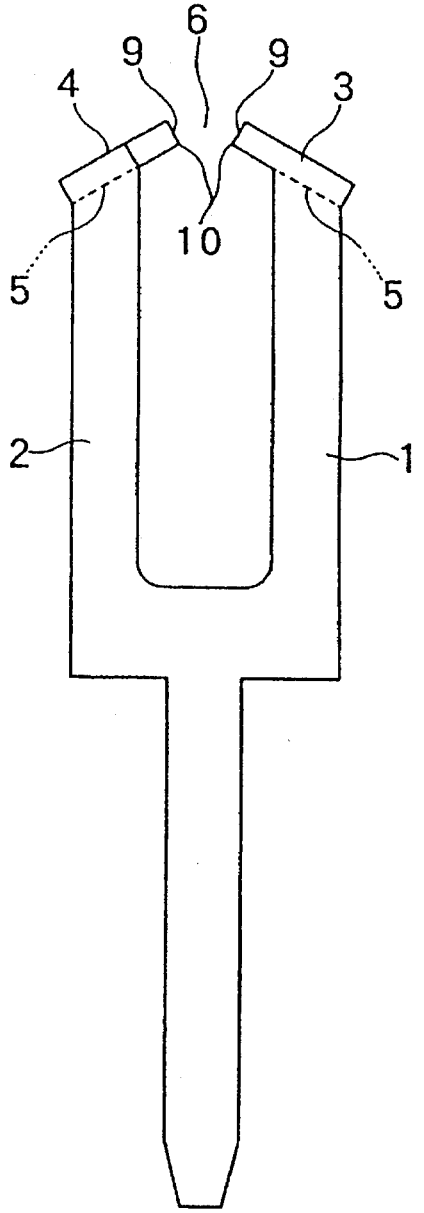
FIG. 6 is a rear view of the electrical contact.
Figure 9:
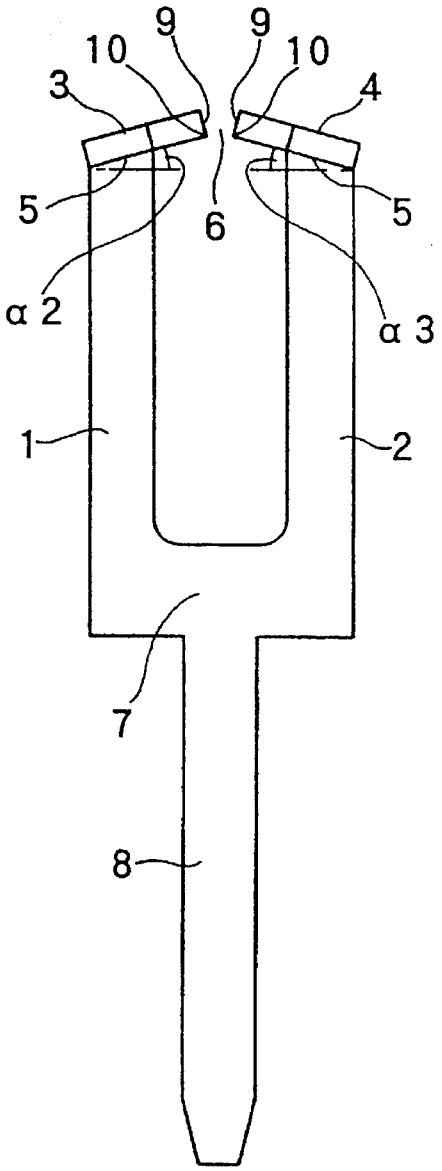
FIG. 9 is a front-elevational view of the electrical contact of FIG. 7.
Figure 10:
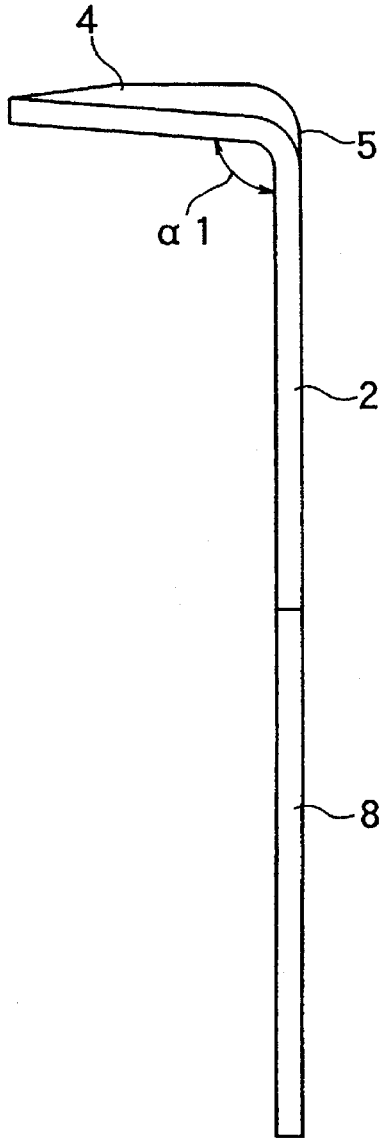
FIG. 10 is a side-elevational view of the electrical contact of FIG. 7.
Figure 11:
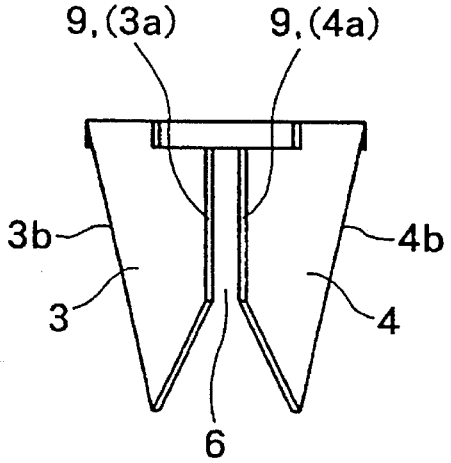
FIG. 11 is a plan view of the electrical contact of FIG. 7.

The lead holding portions 3 and 4 are bent along the respective inclined folding lines 5, and are inclined in accordance with the inclination angles of the inclined folding lines 5, so that blanking shear surfaces 9 of the lead holding portions 3 and 4 which define the lead receiving slot 6 are inclined, as shown in FIGS. 3 and 9.

Because of the inclination of these blanking shear surfaces 9, the lower side of the lead receiving slot 6 is narrowed, so that lower edges 10 of the opposed blanking shear surfaces 9 are disposed closer to each other than upper edges thereof.

As a result, the edges 10 rub opposite side surfaces of a lead wire 11 of an electric part, such as an IC package, introduced into the lead receiving slot 6, and hence tend to generally bit these opposite side surfaces, thereby positively contacting the electrical contact with the lead wire 11, as shown in FIGS. 17 and 18.

The lead wire 11 is in the form of a cylindrical pin, and this pin-like lead wire 11 is introduced into the slot 6 while urging the lead holding portions 3 and 4 away from each other against their resiliency. During this operation, the edges 10 performs a wiping effect.

The present invention can be applied to any construction in so far as each blanked-out surface on which the inclined folding line 5 lies is directed in the forward-rearward direction. Referring to the blanked configuration shown in FIGS. 1 and 7, areas A1 of blanked-out surfaces of leg portions, respectively supporting the lead holding portions 3 and 4, and areas A2 of blanked-out surfaces of the lead holding portions 3 and 4 lie on a common plane.

In the first and second embodiments of the present invention, the blanked-out surfaces A1 on which the inclined folding lines 5 are disposed, respectively, remain directed in the forward-rearward direction (that is, blanking direction) even in a finished form of the electrical contact.

In a finished form of an electrical contact of the third embodiment shown in FIGS. 12 to 15, areas A1 of blanked-out surfaces of leg portions having respective inclined folding lines 5 thereon are bent to be directed left and right, respectively, after blanking except for areas A1' of upper end portions of the blanked-out surfaces, so that the areas A1' remain directed in a forward-rearward direction (i.e., blanking direction).

The difference between the electrical contacts of the first and second embodiments is clear from their blanked configurations shown respectively in FIGS. 1 and 7.

In the first embodiment, the blanking is effected in such a manner that those portions to form the respective lead holding portions 3 and 4 project outwardly left and right respectively beyond the outer side edges of the leg portions of the contact piece portions 1 and 2. In other words, the blanking is effected in such a manner that those portions to form the respective lead holding portions 3 and 4 are inclined outwardly at an angle α4 with respect to the leg portions of the contact piece portions 1 and 2, respectively.

More specifically, inner and outer side edges 3*a* and 3*b* of the upper end portion (which is to form the lead holding portion 3) of the contact piece portion 1 are inclined in parallel relation to each other, while inner and outer side edges 4*a* and 4*b* of the upper end portion (which is to form the lead holding portion 4) of the contact piece portion 2 are inclined in parallel relation to each other. The inner and outer side edges 3*a* and 3*b* and the inner and outer side edges 4*a* and 4*b* are slanting outwardly (left and right) away from each other toward the distal ends of the lead holding portions 3 and 4, so that the outer sides edges 3*b* and 4*b* project outwardly beyond the outer side edges of the leg portions of the contact piece portions 1 and 2, respectively.

The inner and outer side edges 3*a*, 4*a* and 3*b* and 4*b* are defined by respective blanking shear surfaces, and the inner side edges 3*a* and 4*a* cooperate with each other to define the lead receiving slot 6.

In the blanked configuration, the lead holding portions 3 and 4 are slanting outwardly (left and right) away from each other, and also the above inclined folding lines 5 are provided. Because of such arrangement, the electrical contact can be blanked in such a manner that the gap between the lead holding portions 3 and 4 can be increased, and also the width W2 of the lead receiving slot 6 can be made much smaller than the gap W1 between the lead holding portions 3 and 4 in their blanked condition.

Thus, the blanking is carried out in such a manner as to provide the increased gap between the lead holding portions 3 and 4, and then by bending these portions 3 and 4, the receiving slot 6 having the smaller width can be formed.

In the second embodiment shown in FIGS. 7 to 10, the blanking is effected in such a manner that the axes of the lead holding portions 3 and 4 are not inclined, but extend vertically. More specifically, the blanking is effected in such a manner that outer side edges 3*b* and 4*b* of the lead holding portions 3 and 4 extend vertically while inner side edges 3*a* and 4*a* thereof are slanting away from each other toward their distal ends, as shown in FIG. 7.

As shown in FIGS. 1 and 7, on or near to respective extension lines of the inclined folding lines 5, lower ends of the inner side edges 3*a* and 4*a* (that is, the lower ends of the blanking shear surfaces 9) of the lead holding portions 3 and 4 are disposed inwardly of the inner side edges of the contact piece portions 1 and 2, respectively, In the third embodiment shown in FIGS. 12 to 16, the lead holding portions 3 and 4 are disposed out of registry with each other in a vertical direction, so that one of the two portions 3 and 4 is upwardly ahead of the other. As a result, one of the blanking shear surfaces 9 defining the lead receiving slot 6 is upwardly ahead of the other.

In the third embodiment, an inner side edge 3*a* (blanking shear surface 9) of the lead holding portion 3 intersects an inner side edge 4*a* (blanking shear surface 9) of the lead holding portion 4 disposed at a level above the inner side edge 3*a*. In this case, an upper edge 10' of the inner side edge 3*a* is in contact with a lower edge 10 of the inner side edge 4*a*, and the lead receiving slot 6 is closed except for its open inlet portion. Alternatively, the upper and lower edges 10' and 10 intersect each other to form a slight gap therebetween.

In the third embodiment, the blanked-out surface areas A2 of the upper end portions of the contact piece portions 1 and 2 are bent forwardly or rearwardly along the respective inclined folding lines 5 on the blanked-out surfaces A, so that each of the contact piece portions 1 and 2 has a generally inverted L-shape, thereby forming the narrow lead receiving slot 6. And besides, the leg portions of the contact piece portions 1 and 2 are bent in such a manner that the blanked-out surfaces thereof are opposed to each other in the right-left direction, thereby increasing the overall strength of the contact piece portions 1 and 2.

Figure 12:
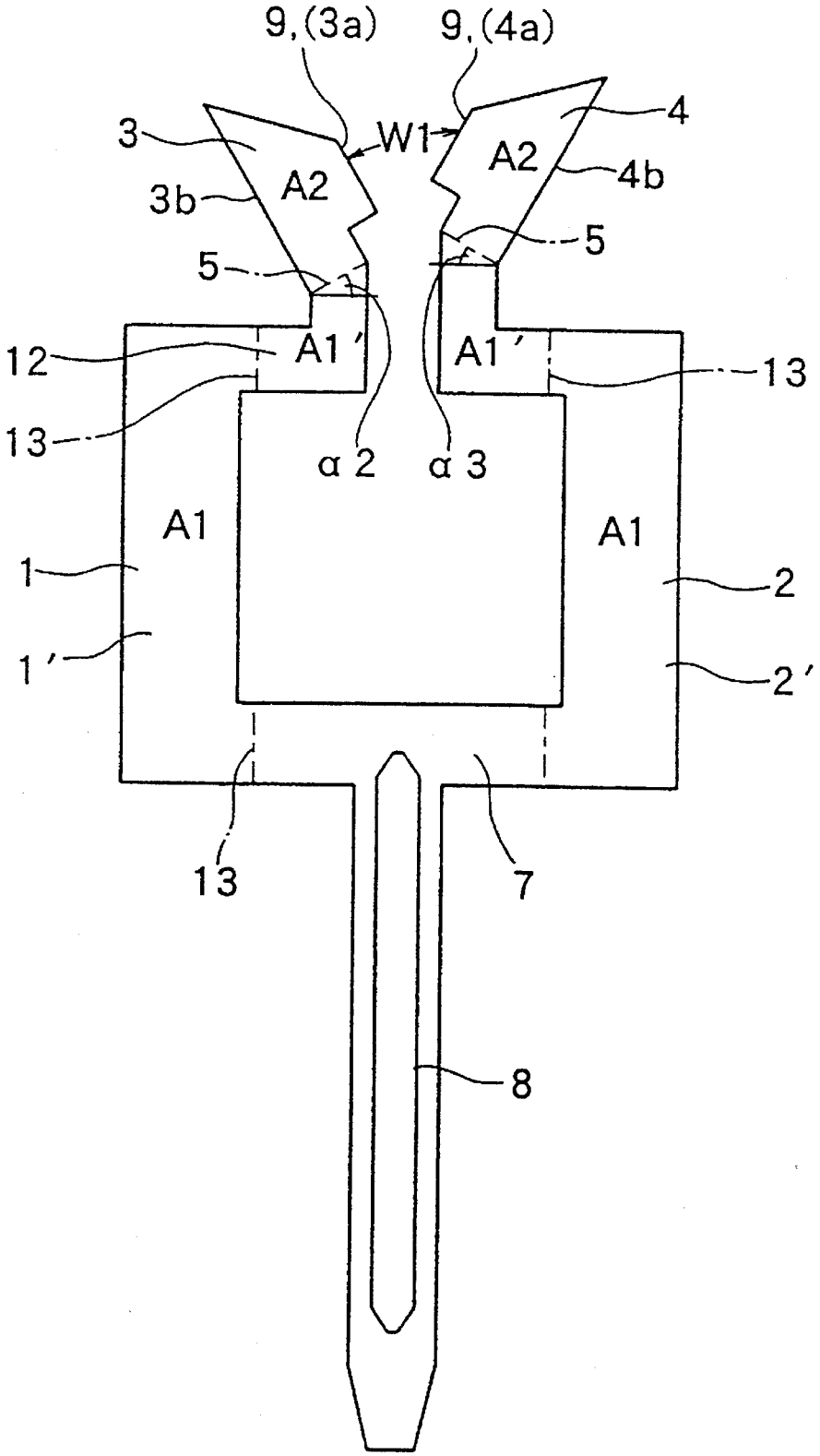
FIG. 12 is a front-elevational view of a third embodiment of an electrical contact of the invention in its blanked configuration.

More specifically, as shown in FIG. 12, the blanking is effected in such a manner that the pair of lead holding portions 3 and 4 are disposed inwardly of the leg portions 1' and 2' of the pair of contact piece portions 1 and 2, respectively. The inclined folding lines 5 are disposed respectively on blanked-out surfaces of upper portions of a pair of inwardly-extending portions 12, each inwardly-extending portion 12 lying between the lead holding portion 3, 4 and the leg portion 1', 2'. The leg portions 1' and 2' are bent substantially perpendicularly respectively along vertically-extending, folding lines 13 disposed respectively on lower portions of the blank-out surfaces of the inwardly-extending portions 12, so that the blanked-out surface areas A1 of the leg portions 1' and 2' are opposed to each other in the right-left direction.

The inclined folding lines 5, disposed respectively on the blanked-out surfaces of the pair of inwardly-extending portions 12, are disposed out of registry with each other in the vertical direction. The blanking is effected in such a manner that the lead holding portions 3 and 4 are different in level or height, with the two inclined folding lines 5 disposed out of registry with each other in the vertical direction.

As a result, the lead holding portions 3 and 4, as well as the opposed blanking shear surfaces 9 defining the lead receiving slot 6, can be disposed out of registry with each other in the vertical direction.

There can be adopted an arrangement in which the inclined folding lines 5 are disposed at the same height or level, and the lead holding portions 3 and 4 are bent at respective angles α1, different from each other, along the respective inclined folding lines 5, so that the blanking shear surfaces 9 of the lead holding portions 3 and 4 are disposed out of registry with each other in the vertical direction. In this embodiment, the blanked-out surface areas A1' each lying between the associated folding lines 5 and 13 remain directed in the forward-rearward direction even in the final form of the electrical contact.

In the third embodiment, the blanking is effected in such a manner that the lead holding portions 3 and 4 are slanting outwardly away from each other toward the distal ends thereof, as in the first embodiment. And besides, the blanking is effected to provide the wide gap W1 between the lead holding portions 3 and 4. With this construction, the width W2 of the lead receiving slot 6 formed as a result of the bending operation can be reduced greatly.

Figure 2:
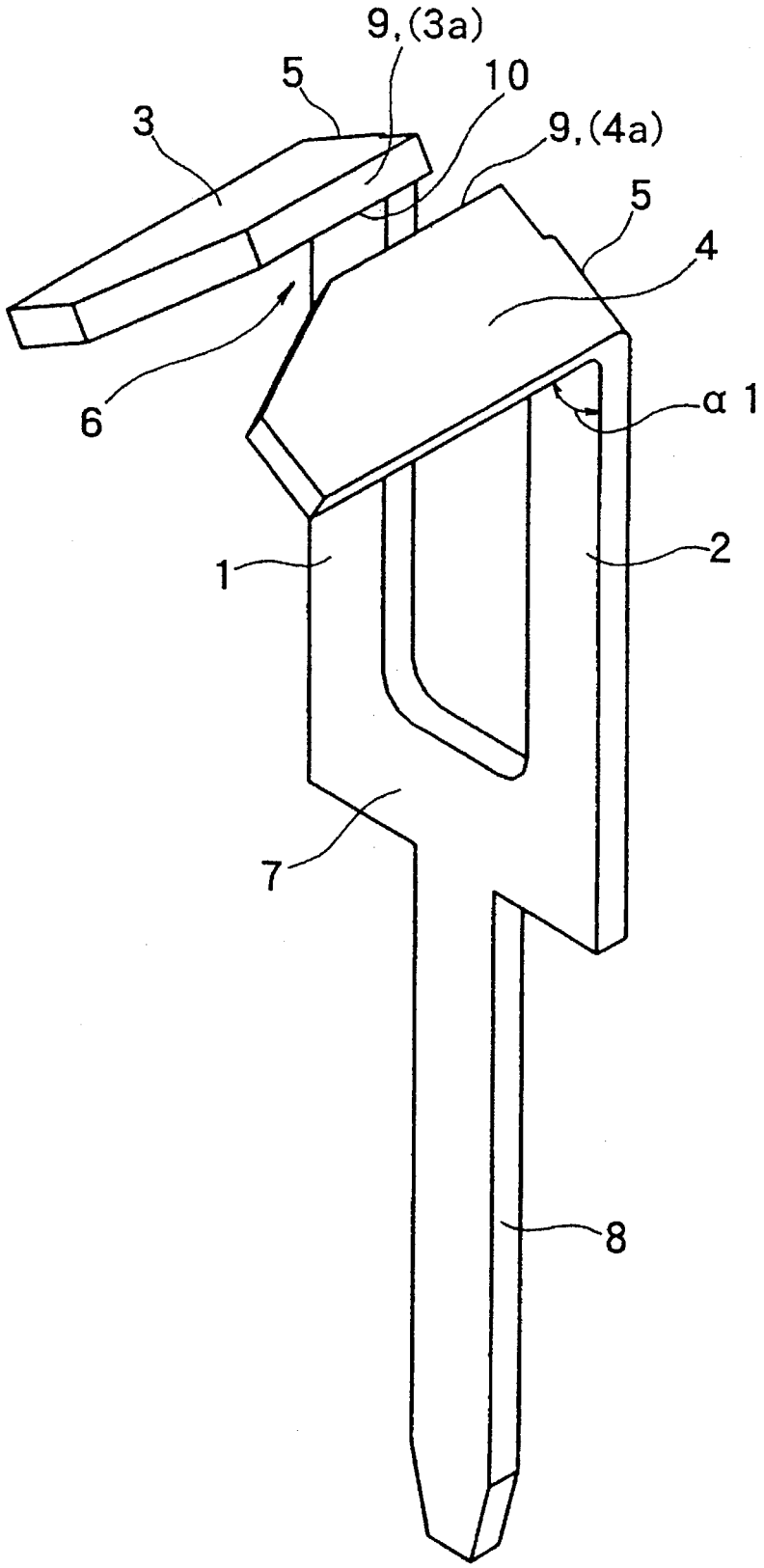
FIG. 2 is a perspective view of the electrical contact, with a pair of lead holding portions bent.
Figure 8:
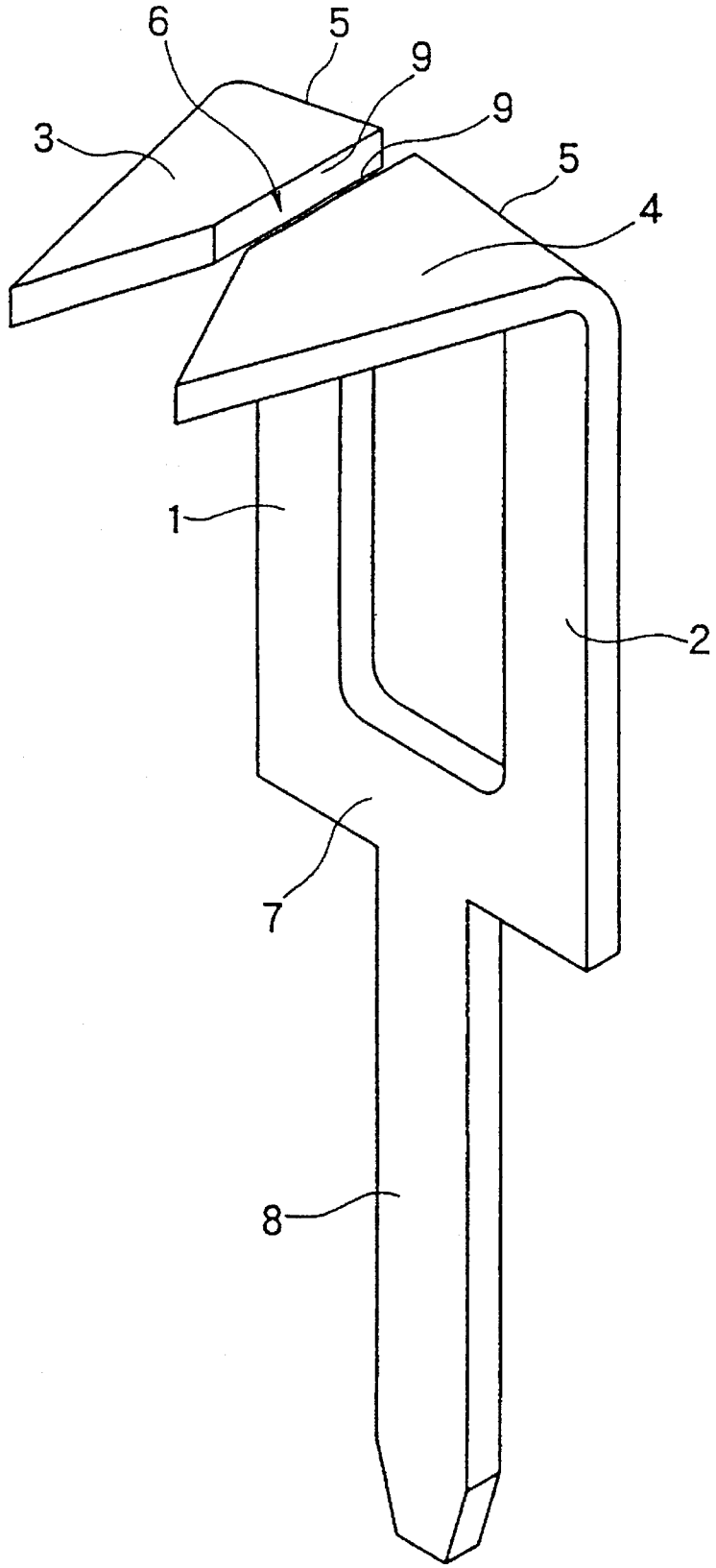
FIG. 8 is a perspective view of the electrical contact of FIG. 7 with a pair of lead holding portions bent.
Figure 13:
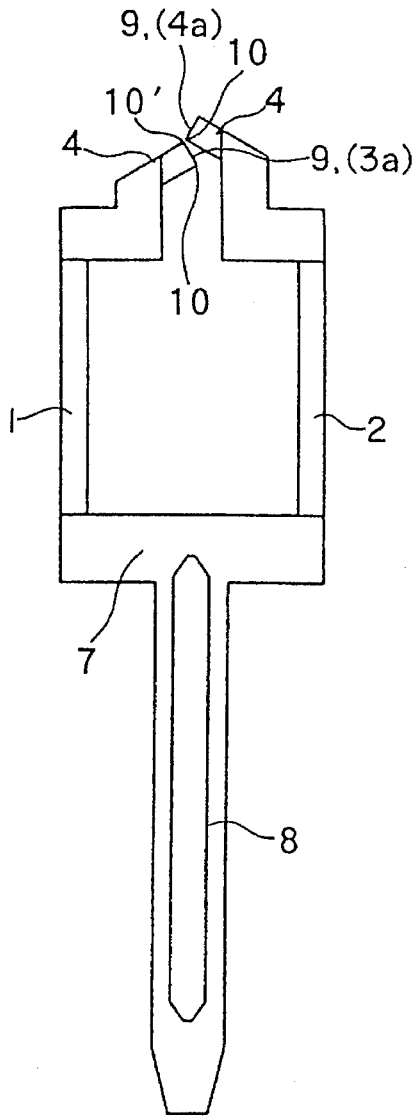
FIG. 13 is a rear view of the electrical contact of FIG. 12.
Figure 14:
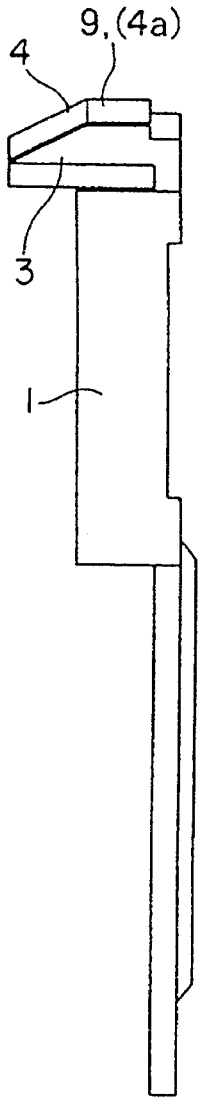
FIG. 14 is a left side-elevational view of the electrical contact of FIG. 12.
Figure 15:
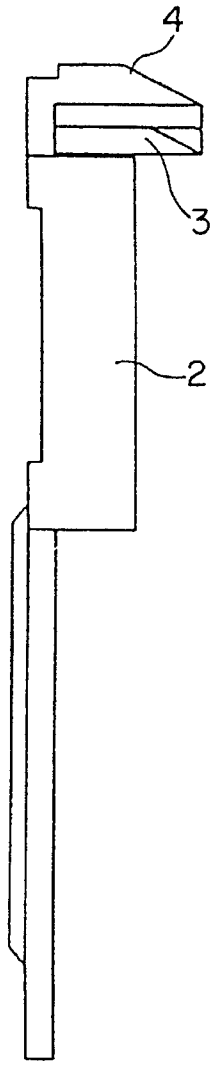
FIG. 15 is a right side-elevational view of the electrical contact of FIG. 12.
Figure 16:
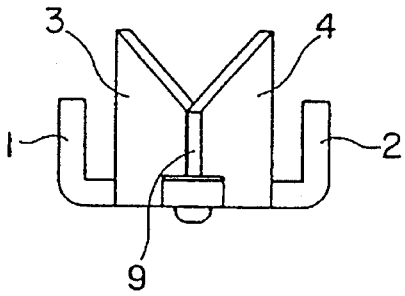
FIG. 16 is a plan view of the electrical contact of the FIG. 12.

In other words, when the lead holding portions 3 and 4 shown in FIGS. 2, 8 and 13 are returned into a developed form along the inclined folding lines 5, the gap W1 between the two lead holding portions 3 and 4 in their developed form is much larger than the width W2 of the lead receiving slot 6.

The effect of obtaining the reduced width of the lead receiving slot 6 can be achieved even if only one of the lead holding portions 3 and 4 is bent along the corresponding inclined folding line 5.

More specifically, even when one of the pair of lead holding portions 3 and 4 is bent along the inclined folding line 5 while the other lead holding portion is bent along a horizontal folding line as in the conventional construction, the gap between the two lead holding portions are gradually decreased in accordance with the bending operation, so that the narrow lead receiving slot 6 can be formed.

As described above, in the present invention, the blanking is effected to provide the wide gap between the pair of lead holding portions, and by bending these lead holding portions, the narrower lead receiving slot can be formed.

The edges of the blanking shear surfaces defining the lead receiving slot contact the lead wire of the electric part under pressure to rub the same, thereby achieving a good wiping effect, so that the reliability in contact between the electrical contact and the lead wire is enhanced.

By suitably determining the inclination angle of the inclined folding lines, the lead receiving slot can have the width suitable for receiving a thin lead wire therein, and besides the lead holding portions suitably resiliently hold the lead wire therebetween.

What is claimed:

1. An electrical contact including a pair of right and left contact piece portions formed by blanking; a pair of lead holding portions formed respectively by forwardly or rearwardly bending upper end portions of said two contact piece portions along respective folding lines disposed respectively on blanked-out surfaces of said contact piece portions directed in a forward-rearward direction; and a slot which is formed between said two lead holding portions, and is defined by blanking shear surfaces of said two lead holding portions; a lead wire of an electric part being adapted to be introduced into said slot so that said lead wire can be held between said two lead holding portions;

wherein one of said two lead holding portions is bent forwardly or rearwardly along the corresponding inclined folding line slanting downwardly from an inner side edge of the associated contact piece portion to an outer side edge thereof, said inclined folding line being disposed on the blanked-out surface of the associated contact piece portion; and wherein as a result of the above bending along said inclined folding line, said one lead holding portion and the blanking shear surface thereof, serving to form said slot, are slanting in respective directions to narrow a width of a lower side of said slot.

2. An electrical contact including a pair of right and left contact piece portions formed by blanking; a pair of lead holding portions formed respectively by forwardly or rearwardly bending upper end portions of said two contact piece portions along respective inclined folding lines disposed respectively on blanked-out surfaces of said contact piece portions directed in a forward-rearward direction, said two inclined folding lines being slanting downwardly outwardly right and left, respectively; and a slot which is formed between said two lead holding portions, and is defined by blanking shear surfaces of said two lead holding portions;

wherein as a result of the above bending along said inclined folding lines, said two lead holding portions and said blanking shear surfaces thereof, serving to form said slot, are slanting in respective directions to narrow a width of a lower side of said slot.

* * * * *